US005247334A

United States Patent [19]

Miyakawa et al.

[11] Patent Number: 5,247,334

[45] Date of Patent: Sep. 21, 1993

[54] IMAGE FORMATION METHOD AND APPARATUS WITH PREHEATING AND PRESSURE IMAGE TRANSFER WITH LIQUID TONER DEVELOPMENT

[75] Inventors: Seiichi Miyakawa, Nagareyama; Shigeru Suzuki, Yokohama, both of Japan

[73] Assignee: Ricoh Company, Ltd., Tokyo, Japan

[21] Appl. No.: 906,661

[22] Filed: Jun. 30, 1992

[30] Foreign Application Priority Data

Jun. 30, 1991 [JP] Japan ..... 3-186824

[51] Int. Cl.[5] ..... G03G 15/01; G03G 15/18

[52] U.S. Cl. ..... 355/271; 355/217; 355/327

[58] Field of Search ..... 355/271, 274, 277, 279, 355/290, 327, 217

[56] References Cited

U.S. PATENT DOCUMENTS 3,923,392 12/1975 Buchan et al. .
3,947,113 3/1976 Buchan et al. .
4,705,385 11/1987 Palm et al. .
4,708,460 11/1987 Langdon .
4,984,026 1/1991 Nishise et al. ..... 355/277
5,053,827 10/1991 Tompkins et al. ..... 355/271
5,099,286 3/1992 Nishise et al. ..... 355/272

*Primary Examiner*—R. L. Moses
*Attorney, Agent, or Firm*—Oblon, Spivak, McClelland, Maier & Neustadt

[57] ABSTRACT

An image formation method for forming an image includes the steps of electrostatically transferring a latent electrostatic image formed on a latent-electrostatic-image bearing member to an intermediate transfer medium composed of at least a support, and an electroconductive layer and a dielectric layer which are successively overlaid on the support, developing the latent electrostatic image which has been electrostatically transferred onto the intermediate transfer medium into a visible image by a wet-type development method, and non-electrostatically transferring the visible image on the intermediate transfer medium to a final recording medium with the application of heat and pressure thereto. An image formation apparatus for carrying out the above method is disclosed.

6 Claims, 2 Drawing Sheets

IMAGE FORMATION METHOD AND APPARATUS WITH PREHEATING AND PRESSURE IMAGE TRANSFER WITH LIQUID TONER DEVELOPMENT

BACKGROUND OF THE INVENTION

1. Field of the Invention

The present invention relates to an image formation method and apparatus for use in an apparatus such as a copying machine, a facsimile machine, or a printer, and more particularly to an image formation method and apparatus capable of producing high quality images by use of a wet-type liquid toner developer.

2. Discussion of Background

Recently, in the field of electrophotographic technology, a digital-type latent image formation method using laser beams has been developed. It is possible to write dot images with a resolution of well over 800 DPI by this method. The development of an image formation method and apparatus which can provide images with high resolution and high quality by using the above-mentioned latent image formation technology is greatly required.

It is necessary to reproduce highly accurate dot images in order to obtain high quality printed images. In such a case, the scattering and collapse of toner particles which occur in the course of the transfer of toner images to a transfer sheet and the fixing of toner images to the transfer sheet with the application of heat or pressure are the main problems to be solved, especially for color printing.

When the particle size of toner particles is minimized, toner images with high resolution can be obtained, and color reproduction can be improved in the case where color printed images are to be obtained by superimposing images with different colors, because the thickness of the toner images transferred to a transfer sheet as a final recording medium can be decreased. Furthermore, the curling of the transfer sheet and cracking of the toner images can be prevented when the particle size of the toner particles is reduced and accordingly the thickness of the transferred toner images is decreased.

There are two types of toners: a powder toner for use in a dry-type development, which is employed together with a powder carrier by triboelectric charging (hereinafter referred to as dry-type toner); and a toner for use in a wet-type development, which is employed by dispersing the toner in a solvent used as a liquid carrier (hereinafter referred to as wet-type or liquid toner development).

When the above-mentioned dry-type toner consists of finely-divided particles with a particle size of the order of 5 μm to submicrons, there are problems that it is difficult to prevent the toner from scattering and to remove any residual toner from the photoconductor which is employed as a latent-image bearing member, after the transfer process.

On the other hand, the same problems as mentioned above do not occur when the wet-type toner is dispersed in a solvent and employed for development. Therefore, the wet-type toner with a small particle size can be easily used.

Furthermore, the toner with a lower melting point is more advantageous with regard to power consumption and high-speed printing. Although the dry-type toner having a low melting point has a blocking problem, the wet-type toner which is dispersed in a solvent during use does not have such a problem. Therefore, the wet-type toner with a low melting point (a low softening point) can be used for high-speed printing.

However, in the case where an electrostatic image transfer method is employed, in which a transfer sheet is brought into contact with the surface of a photoconductor on which a toner image is formed by developing a latent electrostatic image with a wet-type developer, an electric field for image transfer is formed by applying an electric charge to the back side of the transfer sheet with a corona discharger, and the toner image on the photoconductor is transferred to the transfer sheet, the charged transfer sheet is electrostatically attracted by the photoconductor. As a result, the toner image is crushed, so that it becomes difficult to faithfully reproduce line images with accurate line widths and dots with accurate halftone dot areas. For example, even when a toner with a particle size in the order of submicrons is employed for development, the resolution of the obtained images is at most 10 lines/mm.

Moreover, a solvent must be provided between the surface of the photoconductor and the surface of the transfer sheet in order to induce electrophoresis of the toner under the above-mentioned electric field for image transfer. As a result, the solvent wets the transfer sheet. The result is that it becomes difficult to peel the transfer sheet away from the photoconductor, because the surface tension of the solvent and the electrostatic adsorbability of the transfer sheet to the photoconductor work together. Furthermore, it is necessary to sufficiently dry the wet transfer sheet before discharging the transfer sheet from an outlet of a copying machine.

In addition to the above-mentioned method, for example, Japanese Laid-Open Patent Application 63-34573 discloses an image transfer method in which a wet-type toner image is formed on a photoconductor and electrostatically transferred to an intermediate transfer medium. In this image transfer method, in order to reduce the amount of solvent which adheres to a transfer sheet when the toner image is transferred to the transfer sheet, a wet-type toner image formed on a photoconductor is electrostatically transferred to an intermediate transfer medium, and the solvent which adheres to the intermediate transfer medium together with the toner is evaporated by the application of heat thereto. The transfer sheet is then brought into pressure contact with the intermediate transfer medium which bears the toner image thereon under the application of heat in order to carry out the image transfer and image fixing at the same time.

In this method, the transfer of the toner image is carried out twice: the toner image formed on the photoconductor is transferred to the intermediate transfer medium, and then the toner image formed on the intermediate transfer medium is transferred to the transfer sheet. As a result, the resolution of the image finally formed on the transfer sheet is lowered. Even though the latent electrostatic image is formed on the photoconductor by producing a dot image with a resolution much greater than 800 DPI, the toner image obtained on the transfer sheet has a resolution of only about 800 DPI.

In addition to the two above-mentioned methods, the following references disclose image formation methods and apparatus which appear to be related to the present invention. These image formation methods and apparatus, however, use a dry-type developer. These references neither suggest nor teach about a method of obtaining images with high resolution and high image quality using a wet-type developer.

(1) Japanese Patent Publication 64-1028 discloses an image formation method for obtaining toner images with high resolution, in which a toner image is formed on a photoconductor by dry-type development and transferred to an intermediate transfer member with the application of pressure, and then the transferred toner image is fused and transferred to a transfer sheet by the application of pressure and heat thereto using a heat roller. This image formation method is proposed as a method which can replace an electrostatic image transfer method using an electrode for image transfer such as a corona discharger, which has the problem that the resolution of a dry-type toner image is lowered because of the turbulence of the electric field which occurs in the course of the transfer of the dry-type toner image formed on the photoconductor to a transfer sheet.

(2) Japanese Laid-Open Patent Application 60-22171 discloses an image formation method in which a latent electrostatic image is formed on a photoconductor and electrostatically transferred onto an electric-charge bearing member, the latent electrostatic image thus transferred to the electric-charge bearing member is developed with a dry-type developer to form a toner image, and the toner image thus formed on the electric-charge bearing member is transferred and fixed onto a transfer sheet at the same time with the application of pressure and heat.

(3) Japanese Laid-Open Patent Application 58-107564 discloses an image formation method in which a latent electrostatic image is formed on a photoconductor and electrostatically transferred onto an electric-charge bearing member, the latent electrostatic image thus transferred to the electric-charge bearing member is developed with a dry-type developer to form a toner image, the thus formed toner image is transferred to an intermediate member with the application of pressure, and then the toner image thus formed on the intermediate member is transferred and fixed onto a transfer sheet at the same time with the application of pressure and heat.

SUMMARY OF THE INVENTION

Accordingly, a first object of the present invention is to provide an image formation method, which can provide an image with high resolution and high quality on a final, recording medium, using a wet-type developer, and which can employ as the final recording member not only a transfer sheet but also fabric, wood, resin, glass, and metallic plate.

A second object of the present invention is to provide an image formation apparatus using the above-mentioned image formation method.

The first object of the present invention can be achieved by an image formation method for forming an image comprising the steps of {a) electrostatically transferring a latent electrostatic image formed on a latent-electrostatic-image bearing member to an intermediate transfer medium comprising at least a support and an electroconductive layer and a dielectric layer which are successively overlaid on the support, (b) developing the latent electrostatic image which has been electrostatically transferred onto the intermediate transfer medium into a visible image by a wet-type development method, and (c) non-electrostatically transferring the visible image on the intermediate transfer medium to a final recording medium with the application of heat and pressure thereto.

The second object of the present invention can be achieved by an image formation apparatus comprising a latent-electrostatic-image bearing member; means for forming a latent electrostatic image on the latent-electrostatic-image bearing member; an intermediate transfer medium which comprises at least a support, and an electroconductive layer and a dielectric layer successively overlaid on the support, to which the latent electrostatic image on the latent-electrostatic-image bearing member is electrostatically transferred when the intermediate transfer medium is brought into contact with the surface of the latent-electrostatic-image bearing member; means for developing the latent electrostatic image on the intermediate transfer medium into a visible image using a wet-type liquid developer; and means for non-electrostatically transferring the visible image on the intermediate transfer medium to a final recording medium by the application of heat and pressure thereto.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

In the present invention, a latent electrostatic image is formed on a latent-electrostatic-image bearing member and electrostatically transferred to an intermediate transfer medium. The latent electrostatic image formed on the intermediate transfer medium is then developed into a visible image using a wet-type developer. With the application of heat to the visible image on the intermediate transfer medium, a solvent which adheres to the intermediate transfer medium together with the visible image, is evaporated, or the wet-type toner which forms the visible image is fused. As a result, the cohesive force of the wet-type toner is increased, so that the adhesion of the wet-type toner to the surface of the intermediate transfer medium is lowered and the adhesion of the wet-type toner to the surface of the final image transfer medium is increased. Therefore, the properties of the wet-type toner are changed to those of a printing ink. The toner image is formed on the final image transfer medium by transferring the visible image to the final image transfer medium with the application of pressure.

The present invention will now be explained with reference to FIG. 1, which is a schematic cross-sectional view showing the structure of a color printer in which an example of an image formation apparatus according to the present invention is employed.

Figure 1:
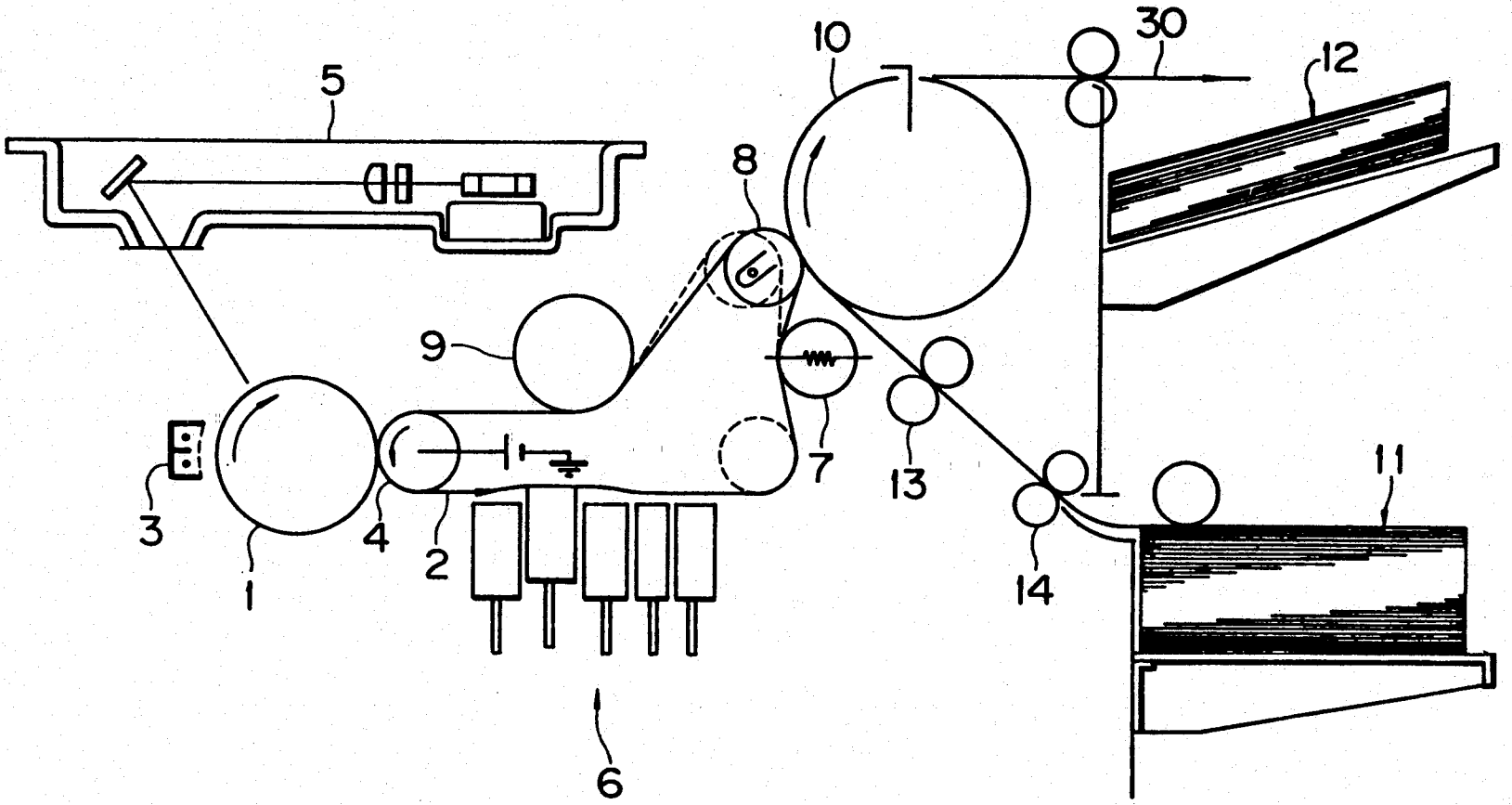
FIG. 1 is a schematic cross-sectional view showing the structure of a color printer in which an example of an image formation apparatus of the present invention is employed.

In the FIG. 1, the surface of a photoconductor drum 1 which rotates in the direction of the arrow (clockwise) is electrically charged to a potential of about 1000

V by a scorotoron charger 3. A latent electrostatic image for a specific color is formed by a laser beam scanner 5. The thus formed latent electrostatic image is electrostatically transferred by an electrostatic transfer roller 4 to which a predetermined bias voltage is applied, onto a dielectric belt 2 which comprises at least an electroconductive layer and a dielectric layer overlaid on the electroconductive layer, and rotates in the direction of the arrow (counterclockwise), so that a latent electrostatic image with a potential of about 120 V is formed on the dielectric belt 2.

The latent electrostatic image formed on the dielectric belt 2 is developed into a visible image by a liquid developer contained in a development unit for the above-mentioned specific color in a group of wet-type development units 6. At the same time, an excess of a liquid developer adhering to the surface of the dielectric belt 2 is squeezed from the belt, and a toner image in the form of a toner layer containing a slight amount of the solvent therein is obtained.

The toner image is transported to a contact area of the dielectric belt 2 with which a preheating roller 7 is brought into contact by a spring. The solvent contained in the toner image is evaporated by conduction heat and an air fan (not shown). The toner image is then transported onto a thermal image transfer roller 8 into which a heat source lamp is built. Instead of the preheating roller 7, heat application means using radiation heat can also be employed for achieving the above purpose without causing the destruction of the toner image.

Transfer sheets 30 fed from a paper supply stack 11 are individually separated by a separation roller 14. The transportation of the transfer sheets 30 is controlled in such a manner that the leading edge of each transfer sheet is precisely positioned on a clamper of a transfer sheet drum 10 by a resist roller 13. In the course of the transportation of the transfer sheet 30 onto the transfer sheet drum 10, the thermal image transfer roller 8 is supported in the position indicated by the broken line. The transfer sheet 30 supported by the transfer sheet drum 10 is brought into pressure contact with the surface of the dielectric belt 2 when the thermal image transfer roller 8 is moved to the position indicated by the solid line, so that the toner image on the dielectric belt 2 is fused by the heat applied from the thermal image transfer roller 8 and transferred and fixed onto the transfer sheet 30 at the same time. As a matter of course, the toner image on the dielectric belt 2 is controlled in such a manner that the toner image is resistered on the transfer sheet 30.

At every rotation of the transfer sheet drum 10 which supports the transfer sheet 30, each of the toner images of different colors formed o the dielectric belt 2 is transferred to the transfer sheet 30, for example, in such a manner that yellow, cyan, magenta, and black images are successively superimposed, whereby a color image is printed on the transfer sheet 30. The transfer sheet 30 on which the toner image has been formed is then transported to a paper discharge portion 12.

A cooling heat pipe 9 contacts the surface of the dielectric belt 2 which passes over the thermal image transfer roller 8 and is directed to the electrostatic transfer roller 4. Because the cooling heat pipe 9 can prevent the elevation of the temperature of the dielectric belt 2, high-speed printing can be carried out.

Figure 2:
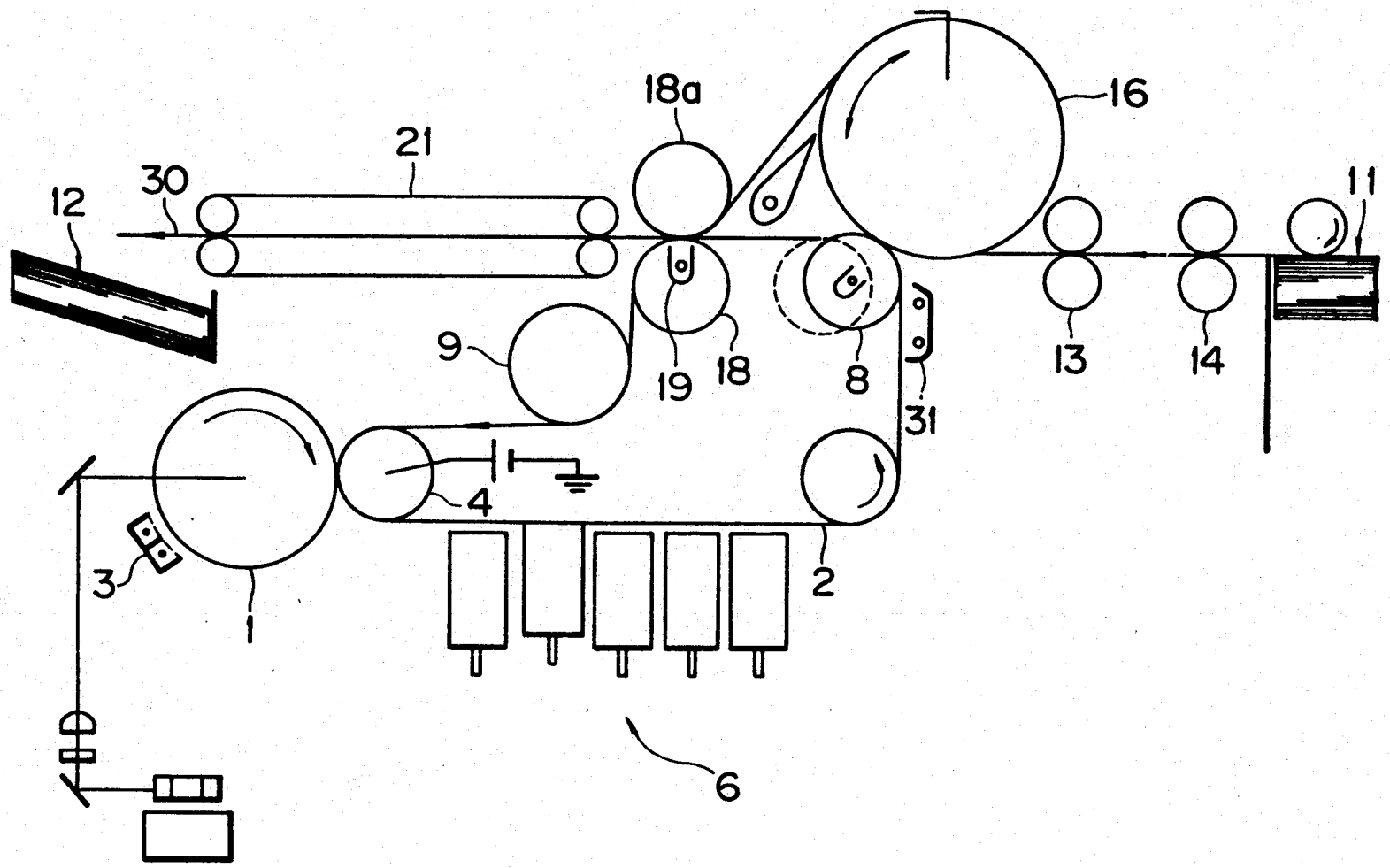
FIG. 2 is a schematic cross-sectional view showing the structure of a color printer in which another example of an image formation apparatus of the present invention is employed.

FIG. 2 is a schematic cross-sectional view of the structure of a color printer in which another example of the image formation apparatus according to the present invention is employed.

In this FIG. 2, the same reference numerals as in FIG. 1 designate identical or corresponding parts of the color printer.

In the color printer shown in FIG. 2, each of the latent electrostatic images of different colors is transferred to a dielectric belt 2 and developed into a visible image on the dielectric belt 2. Each of the thus developed images of different colors is superimposed on the dielectric belt 2.

Transfer sheets 30 are individually fed from a paper supply stack 11. Each of the transfer sheets 30, with the leading edge thereof being held by a clamper, is supported on a reversibly rotatable drum 16 for supporting the transfer sheet. The transfer sheet 30 is brought into pressure contact with the dielectric belt 2 by a thermal image transfer roller 8 for front side image transfer, so that a color image on the dielectric belt 2 is transferred by this single step to the transfer sheet 30. In the course of the image transfer, both a radiation lamp 31 and the thermal image transfer roller 8 work as preheating means.

The leading edge of the transfer sheet 30 with the color image printed on the front side thereof is clamped to the reversible rotatable drum 16, the rotating direction of which is then reversed. The transfer sheet 30 is then fed into a contact area between the surface of the dielectric belt 2 on a back side thermal image transfer roller 18 for back side image transfer and a back-up roller 18*a* in such a manner that the rear edge of the transfer sheet 30 is directed to the contact area. After passing through the above-mentioned contact area, the transfer sheet 30 is transported onto a paper discharge portion 12 by a conveyor belt 21.

When images are to be printed on both sides of the transfer sheet 30, a first image and a second image are successively formed on the dielectric belt 2 with a small space between the two images. After the first image is transferred to the transfer sheet 30, the direction of the reversibly rotatable drum 16 is changed. The second image is transferred, under the application of pressure, using a back side thermal image transfer roller 18, to the back side of the transfer sheet 30 which passes through the contact area between the surface of the dielectric belt 2 on the back side thermal image transfer roller 18 and the back-up roller 18*a*. Thus, the color images are formed on both sides of the transfer sheet, whereby a duplex color image print can be obtained.

In this color printer shown in FIG. 2, each color toner image is superimposed on the dielectric belt 2 to produce a color toner image. The thus produced color image is then transferred to the transfer sheet 30 in a single step. For example, when toner images with four different colors are superimposed, it is not necessary to operate a radiation lamp 31 and the thermal image transfer roller 8 at least during three revolutions of the dielectric belt 2. When the radiation lamp 31 and the thermal image transfer roller 8 are not operated, the amount of power consumption can be reduced and the dielectric belt 2 can be cooled. Therefore, high-speed printing can be carried out.

Moreover, in this color printer, even when a resin, fabric, glass, wood, or metal is employed as the material for the final recording medium instead of the transfer sheet 30, printed images can be easily obtained by transferring and fixing the toner images for each color superimposed on the dielectric belt 2 in a single step onto the final recording medium by the application of pressure.

It is also possible to use each of the thermal image transfer rollers 8 and 18 in the color printers shown in FIG. 1 and FIG. 2 as heat sources, and heat the toner image on the dielectric belt 2 by heat conducted from these rollers. However, in this case, it is necessary to increase the temperature of the dielectric belt 2 in its entirety in the direction of the thickness thereof. When the heat capacity of the dielectric belt 2 is taken into consideration, the above-mentioned structure of the color printer is not preferable for reducing the amount of power consumption and for controlling the temperature of the photoconductor.

In the case where the color printer is constructed in such a fashion that only the toner is heated with radiant heat since each color toner has a different radiant heat absorption rate, the fusing degree of each color toner and the evaporation degree of the solvent contained in each color toner differ. When each color toner is composed to satisfy the radiant heat absorption characteristics in order to solve the above-mentioned problem, the color reproduction performance has to be sacrificed.

Therefore, it is preferable to employ a method disclosed in Japanese Patent Publication 55-18907. According to this method, the dielectric belt is composed of a thin radiant ray absorption layer which supports the toner images and a radiant ray transmission layer which serves as a substrate which supports the radiant ray absorption layer, and the dielectric belt is heated by a heat source such as an infrared lamp which is provided on the side of the substrate in such a manner that the light from the infrared lamp is concentrated on only the radiant ray absorption layer.

More specifically, each of the thermal image transfer rollers 8 and 18 is composed of a material which can transmit the radiant rays, for instance, from the infrared lamp which is built in each of the above rollers. A dielectric layer serving as a surface layer of the dielectric belt 2 which supports the toner images thereon comprises a thin black layer which can easily absorb infrared rays, with a thickness of 5 μm or less, preferably 2 to 3 μm. An electroconductive layer and a substrate, which are disposed under the dielectric layer, are made of a semiopaque material through which infrared rays are allowed to pass. The electroconductive layer serves to make the temperature distribution of the dielectric belt 2 uniform. Therefore, it is preferable that the electroconductive layer be thin. It is also preferable that the substrate be made of a heat-insulating material. The dielectric belt 2 is composed of these three layers which are laminated so that they do not peel away as the result of heating and cooling. The dielectric belt 2 prepared in the above-mentioned configuration can promptly respond to the changes in the temperature, because the heat capacity of the dielectric layer and that of the electroconductive layer in the dielectric belt 2 are small.

Because of the above-mentioned structures of the thermal image transfer rollers 8 and 18 and the dielectric belt 2, it is possible to restrict the portion of the dielectric belt 2 at which the temperature is increased to a locally limited portion. The above-mentioned effects of the thermal image transfer rollers 8 and 18 and dielectric belt 2, together with the cooling effect of the cooling heat pipe 9, so function that high-speed printing can be carried out at a speed of 100 sheets/min.

When the dielectric layer of the dielectric belt is made of an elastic material such as a silicone rubber which has excellent releasability, excellent toner releasability can be maintained even at high temperatures. Moreover, the crushing of toner particles can be effectively avoided because of the elastic deformation of the dielectric layer.

In each of the color printers shown in FIGS. 1 and 2, the electric potential of the latent electrostatic image formed on the dielectric belt 2 is a small fraction of that of the latent electrostatic image formed on a conventional electrophotoconductive photoconductor. Therefore, in order to obtain images with sufficiently high density for high-speed printing, it is preferable that the concentration of a toner contained in a wet-type developer be high, a development electrode be provided in close proximity to the latent electrostatic image on the dielectric belt 2, and a sufficient amount of the developer be circulated in a portion between the development electrode and the dielectric belt 2.

Moreover, the preheating roller 7 and the radiation lamp 31 are respectively provided as preheating means in the color printers shown in FIGS. 1 and 2. However, when the solvent contained in the toner image can be evaporated or the toner can be fused sufficiently only by the thermal image transfer rollers 8 and 18, it is not necessary to provide the above-mentioned preheating roller 7 and the radiation lamp 31. On the contrary, when the evaporation of the solvent contained in the toner image and the fusion of the toner can be sufficiently carried out only by the preheating roller 7 and the radiation lamp 31, it is not necessary to provide the preheating function in the thermal image transfer rollers 8 and 18.

In addition, the transfer efficiency can be improved by applying to the thermal image transfer rollers 8 and 18*a* bias voltage for forming an electric field which can transport the toner on the dielectric belt 2 to the transfer sheet.

According to the present invention, the cohesive force of the wet-type toner which forms the visible image on the intermediate transfer medium is increased by the application of heat, so that the transfer capability of the above wet-type toner is improved, and the visible image on the intermediate transfer medium is transferred to the final recording medium by the application of pressure. Therefore, in contrast with the electrostatic transfer method using a corona discharger, the image formation method of the present invention can prevent the crushing of the toner image during the image transfer process, so that the visible image can be transferred to the final recording medium with high image density.

Moreover, in the image formation method of the present invention, the latent electrostatic image formed on the latent-electrostatic-image bearing member is electrostatically transferred to the intermediate transfer medium, the thus transferred latent electrostatic image is developed into a visible image by a wet-type developer, and the thus obtained visible image is transferred to the final recording medium. Therefore, the number of visible image transfer processes can be reduced in comparison with the case where the latent electrostatic image is developed into a visible image on the latent-electrostatic-image bearing member by a wet-type developer and the thus obtained visible image is transferred to the intermediate transfer medium. As a result, the reduction in the resolution of the toner image, which may occur when the toner image is repeatedly transferred, can be avoided and images with high resolution and high quality can be obtained.

In addition to the above, the power consumption for heating the toner image when the toner image is transferred to the final recording medium can be decreased, because a wet-type toner with a low softening point is employed for the development of latent electrostatic images. Therefore, high-speed printing can be carried out.

Furthermore, according to the present invention, each of the visible images of different colors formed on the intermediate transfer medium is transferred to the final recording medium. Therefore, the interval between the formations of each of the visible images of different colors on the intermediate transfer medium may correspond to a cycle in which each portion of the surface of the final recording medium passes through the contact area between the above portion and the intermediate transfer medium, and the entire circumferential length of the intermediate transfer medium in the moving direction thereof can be selected as desired. Moreover, even when a long cycle is set for heating and cooling, high-speed printing can be carried out. In addition, it is possible to fabricate a compact size intermediate transfer medium by using a belt or drum with a relatively short circumferential length.

Furthermore, according to the present invention, each of the visible images of different colors is superimposed on the intermediate transfer medium after each of the latent electrostatic images for different colors has been electrostatically transferred to the intermediate transfer medium, and each of the latent electrostatic images of different colors on the intermediate transfer medium has been developed into a visible image. After that, heat is applied to the toner image for transferring the toner image to the final recording medium. For example, when a color toner image is to be obtained by superimposing the images of four different colors, the time which is necessary for the application of heat for forming each of the latent electrostatic images for four different colors on the latent-electrostatic-image bearing member and the development of each of these latent electrostatic images into a visible image is about ¼ the time in the case where conventional image formation methods are employed. Therefore, the power consumption can be reduced and high-speed printing can be carried out.

In the present invention, because the color image is formed on the final recording medium by transferring in a single step the superimposed toner images of different colors on the intermediate transfer medium to the final recording medium, resin, fabric, wood, glass, and metals can also be employed as the material for the final recording medium.

What is claimed is:

1. An image formation method for forming an image comprising the steps of:

electrostatically transferring a latent electrostatic image formed on a latent-electrostatic-image bearing member to an intermediate transfer medium comprising at least a support and an electroconductive layer and a dielectric layer which are successively overlaid on said support;

developing said latent electrostatic image which has been electrostatically transferred onto said intermediate transfer medium into a visible image by a liquid toner development method;

heating said visible toner image formed on said intermediate transfer medium by a heating roller; and non-electrostatically transferring said visible image on said intermediate transfer medium to a final recording medium with the application of heat and pressure thereto.

2. The image formation method for forming an image as claimed in claim 1, wherein said image is a color image which is formed on said final recording medium comprising the steps of:

(a) electrostatically transferring latent electrostatic images for each color to said intermediate transfer medium, (b) developing each of said latent electrostatic images into a visible image of a different color, (c) superimposing each of said visible images on said intermediate transfer medium, and (d) transferring said superimposed visible images to said final recording medium by one transfer process, thereby producing said color image.

3. The image formation method for forming an image as claimed in claim 1, wherein said image is a color image which is formed on said final recording medium comprising the steps of:

(a) electrostatically transferring latent electrostatic images for each color to said intermediate transfer medium, (b) developing each of said latent electrostatic images into a visible image of a different color, and (c) transferring each of said visible images of different colors to said final recording medium in such a manner as to superimpose each of said visible images on said final recording medium.

4. An image formation apparatus comprising:

a latent-electrostatic-image bearing member;

means for forming a latent electrostatic image on said latent-electrostatic-image bearing member;

an intermediate transfer medium which comprises at least a support, and an electroconductive layer and a dielectric layer successively overlaid on said support, to which said latent electrostatic image on said latent-electrostatic-image bearing member is electrostatically transferred when said intermediate transfer medium is brought into contact with the surface of said latent-electrostatic-image bearing member;

means for developing said latent electrostatic image on said intermediate transfer medium into a visible image using a liquid toner developer;

a heating roller for heating said visible toner image formed on said intermediate transfer medium; and means for non-electrostatically transferring said visible image on said intermediate transfer medium to a final recording medium by the application of heat and pressure thereto.

5. The image formation method according to claim 1, further comprising the step of cooling the intermediate transfer medium.

6. The image formation apparatus according to claim 4, further comprising means for cooling the intermediate transfer medium.

* * * * *

UNITED STATES PATENT AND TRADEMARK OFFICE

CERTIFICATE OF CORRECTION

PATENT NO. : 5,247,334

DATED : SEPTEMBER 21, 1993

INVENTOR(S) : SEIICHI MIYAKAWA, ET AL.

It is certified that error appears in the above-indentified patent and that said Letters Patent is hereby corrected as shown below:

In column 3, line 58, change "{a)" to --(a)--.

In column 7, line 67, after "belt" insert --2--.

Signed and Sealed this

Twenty-fourth Day of January, 1995

*Attest:*

*Attesting Officer*

BRUCE LEHMAN

*Commissioner of Patents and Trademarks*